US006708481B2

(12) United States Patent
Kamen et al.

(10) Patent No.: US 6,708,481 B2
(45) Date of Patent: Mar. 23, 2004

(54) FUEL INJECTOR FOR A LIQUID FUEL BURNER

(75) Inventors: Dean L. Kamen, Bedford, NH (US); Christopher C. Langenfeld, Nashua, NH (US); Michael Norris, Manchester, NH (US)

(73) Assignee: New Power Concepts LLC, Manchester, NH (US)

( * ) Notice: Subject to any disclaimer, the term of this patent is extended or adjusted under 35 U.S.C. 154(b) by 0 days.

(21) Appl. No.: 10/382,089

(22) Filed: Mar. 5, 2003

(65) Prior Publication Data

US 2003/0177764 A1 Sep. 25, 2003

Related U.S. Application Data

(60) Provisional application No. 60/365,657, filed on Mar. 19, 2002.

(51) Int. Cl.[7] ..... F02C 5/00

(52) U.S. Cl. ..... 60/39.6; 60/517

(58) Field of Search ..... 60/39.6, 517, 520, 60/521, 522, 523, 524, 526

(56) References Cited

U.S. PATENT DOCUMENTS

| | | | | |
|---|---|---|---|---|
| 3,775,973 A | | 12/1973 | Hudson | |
| 3,798,901 A | | 3/1974 | Lewenhaupt | |
| 4,008,039 A | | 2/1977 | Compton et al. | |
| 4,067,191 A | | 1/1978 | Gronvall et al. | |
| 4,231,222 A | | 11/1980 | Fenton | |
| 4,364,724 A | | 12/1982 | Alpkvist | |
| 4,615,173 A | | 10/1986 | Usui et al. | |
| 5,065,579 A | | 11/1991 | Monahan | |
| 5,158,261 A | | 10/1992 | Morohoshi | |
| 5,590,526 A | | 1/1997 | Cho | |
| 5,735,468 A | * | 4/1998 | Casey | 239/425 |
| 5,954,039 A | | 9/1999 | Doering et al. | |
| 6,062,023 A | * | 5/2000 | Kerwin et al. | 60/520 |
| 6,230,683 B1 | * | 5/2001 | zur Loye et al. | 123/435 |
| 6,247,310 B1 | | 6/2001 | Norris et al. | |
| 6,302,080 B1 | | 10/2001 | Kato et al. | |
| 6,381,958 B1 | * | 5/2002 | Kamen et al. | 60/517 |

FOREIGN PATENT DOCUMENTS

| | | |
|---|---|---|
| DE | 12 77 499 B | 9/1968 |
| DE | 41 13 067 A1 | 10/1992 |
| DE | 100 07 164 A1 | 8/2000 |
| EP | 0 454 351 A2 | 10/1991 |
| JP | 04347410 | 12/1992 |
| JP | 09015197 | 1/1997 |

* cited by examiner

*Primary Examiner*—Hoang Nguyen
(74) *Attorney, Agent, or Firm*—Bromberg & Sunstein LLP

(57) ABSTRACT

A fuel injector for a liquid fuel burner that provides for large turn-down ratios and low firing rates. The fuel injector has a fast acting valve to provide a pulsed flow of fuel from a fuel supply and a nozzle coupled to the valve for receiving and atomizing the pulsed flow of fuel. The pulse of atomizing fuel is injected into the throat of a burner. A fuel controller coupled to the fuel supply and the fuel injector governs the rate of fuel delivery by controlling the duration and frequency of an opening period of the fast acting valve.

14 Claims, 3 Drawing Sheets

FUEL INJECTOR FOR A LIQUID FUEL BURNER

This application claims priority from U.S. provisional patent application, Ser. No. 60/365,657, filed Mar. 19, 2002, entitled "FUEL INJECTOR FOR A LIQUID FUEL BURNER," which is incorporated herein by reference in its entirety.

TECHNICAL FIELD

The present invention pertains to burner components, such as the burner components of an engine or other power source, and more particularly to a fuel injector for a liquid fuel burner.

BACKGROUND OF THE INVENTION

Burners, such as liquid fuel burners, may be used in a wide range of applications including power sources, heat sources, heating appliances and light sources. Typically, it is desirable to have a burner with properties such as high thermal efficiency and low emissions. One method to achieve low emissions is to mix a fuel with air before burning the fuel in the burner. Liquid hydrocarbons, such as kerosene and heating oil, need to first be evaporated before being mixed with air for burning. The evaporation of fuel in high power burners is traditionally achieved by atomizing the fuel into a fog of droplets that readily evaporate and mix with the combustion air. Liquid fuels are typically atomized by forcing the liquid fuel through a small hole with significant pressure. However, such an approach is typically limited to burner powers above 12 kW. Below this flow rate, good atomization requires impracticably small holes. Small oil heaters typically use wicks to evaporate the fuel and mix it with air. However, it is difficult to turn down a wick burner and it is therefore not a good choice for a burner for a power source such as an engine.

In addition to the limited low flow capabilities, another problem with typical fuel injectors is the coking of the fuel in the injector. Coking is the de-hydrogenation of the liquid hydrocarbon fuel that produces a tar that clogs the fuel injector ports. This is particularly a problem during shut down of a burner when the fuel flow is stopped while the burner is hot. The fuel left in the hot injector bakes and forms tar deposits.

As mentioned, a burner may be used in a power source, such as an engine. A burner for a thermal cycle engine, such as a Stirling cycle engine, should have a high thermal efficiency, low emissions, good cold starting capabilities and a large turndown ratio or wide dynamic range. Stirling cycle machines, including engines and refrigerators, have a long technological heritage, described in detail in Walker, *Stirling Engines,* Oxford University Press (1980), incorporated herein by reference. High thermal efficiency may be achieved by preheating the air that will be mixed with the fuel in the burner to approximately the Stirling heater head temperature. As discussed previously, low emissions may be achieved by mixing the fuel with the preheated air before burning the fuel in the burner. However, a burner for a thermal cycle engine should also be capable of being ignited and warmed-up with ambient temperature air. Therefore, the burner should be capable of good fuel/air mixing and flame stabilization over a wide range of air temperatures. In addition, the burner should be capable of good fuel/air mixing over a wide range of fuel flows.

SUMMARY OF THE INVENTION

In accordance with embodiments of the invention, a liquid fuel burner is provided for combusting a fuel-air mixture.

The liquid fuel burner includes a fuel injector for injecting the fuel into the air in a throat of the burner so that the fuel and air mix to form the fuel-air mixture. The fuel injector has a fast acting valve to provide a pulsed flow of fuel and a nozzle coupled to the valve for receiving and atomizing the pulsed flow of fuel. The pulse of atomizing fuel is injected into the burner throat. The burner may include one or more air registers to direct air into the burner throat. The burner further includes a combustion chamber coupled to the throat of the burner for receiving and igniting the fuel air mixture using an igniter. A fuel controller coupled to the fuel supply and the fuel injector governs a rate of fuel delivery by controlling the duration of an opening period of the fast acting valve.

In one embodiment, the fuel controller governs the rate of fuel delivery by varying the frequency of the fast acting valve. Alternatively, the fuel controller may govern the rate of fuel delivery by varying a fuel pressure provided by a fuel pump coupled to the fuel supply. In a further embodiment, the fuel controller includes a pulse width modulated driver to control the frequency and duration of fast acting valve openings. The liquid fuel burner may further include a cooling loop coupled to the fuel supply and the fuel injector for cooling the fuel injector. The valve may be an automotive fuel injector designed for port fuel injection. The nozzle may be a pressure-atomizing oil burner nozzle. The fuel injector may be an automotive gasoline direct injection fuel injector. Alternatively, the fuel injector may be a diesel common rail injector.

In another embodiment, the liquid fuel burner may be used to provide heat to a thermal cycle engine having a heater head for heating a working fluid by conduction. The fuel flow rate may be controlled to maintain a desired heater head temperature. The fuel flow rate is varied by a controller that varies at least one parameter of a control signal to the fuel injector valve based on the desired heater head temperature and measured heater head temperature. The control signal has the following parameters: signal amplitude, frequency and duty cycle.

In another embodiment, the liquid fuel burner further includes a mixing chamber coupled to the fuel injector for mixing the injected fuel and a portion of the air from the air supply before entry into the throat of the burner. The mixing chamber may include a mesh metal surface to absorb and evaporate the fuel. The mixing chamber may have a plurality of openings through which the portion of air enters the mixing chamber. In one embodiment, the mixing chamber is a cylinder aligned with the fuel injector.

BRIEF DESCRIPTION OF THE DRAWINGS

The invention will be more readily understood by reference to the following description, taken with the accompanying drawings, in which.

DETAILED DESCRIPTION OF PREFERRED EMBODIMENTS

While the invention will be described generally with reference to a Stirling engine, it is to be understood that many engines, burners, and other machines may similarly benefit from various embodiments and improvements that are subjects of the present invention.

In accordance with embodiments of the present invention, a liquid fuel burner with a pulsed fuel injector is provided that provides substantially complete and clean combustion over large turn-down ratios, very low firing rates and good durability. The liquid fuel burner of the present invention may be used in Stirling engines, particularly small (<3 kWe) Stirling engines, thereby expanding the range of operating fuels for such engines and improving the portability of small Stirling engine applications. A small liquid burner may have applications in other small continuously fired power sources such as fuel cells and brayton-cycle engines. In addition, the liquid fuel burner as disclosed may be used in other applications requiring a small liquid burner, for example, heating small spaces such as truck and boat cabins and small heating applications such as glass and ceramic kilns.

Figure 1:
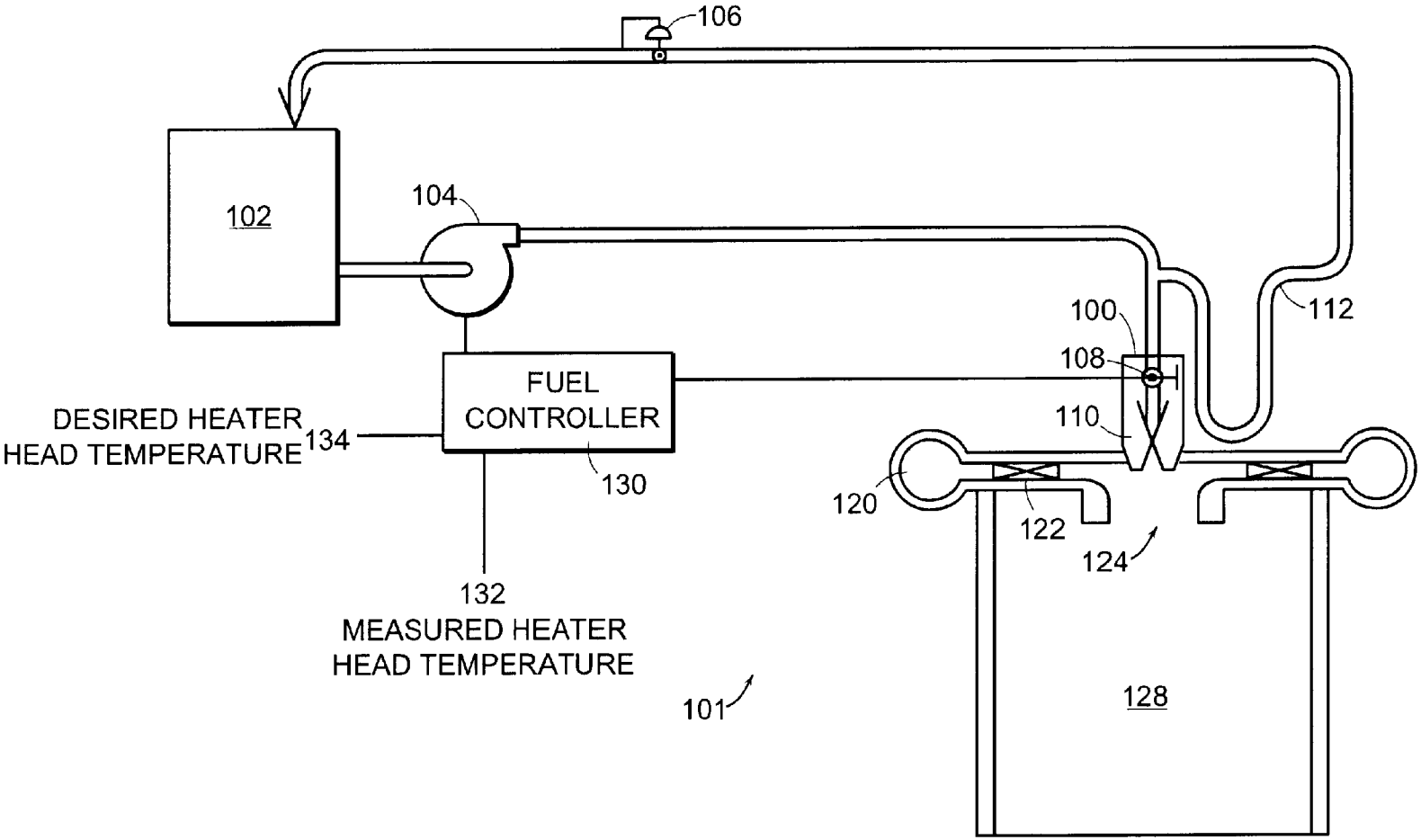
FIG. 1 is a schematic diagram of a burner with an intermittent fuel injector in accordance with an embodiment of the invention.

Referring to FIG. 1, a burner including an intermittent fuel injector, in accordance with preferred embodiments of the invention, is shown schematically and designated generally by numeral 101. Burner 101 includes, among other components, an intermittent fuel injector 100 and a cooling loop 112. The intermittent fuel injector 100 includes a valve 108 and a nozzle 110. In a preferred embodiment, valve 108 is a fast solenoid valve. Intermittent injector 100 produces good atomization of a liquid fuel and low fuel flow rates by producing periodic sprays of fuel at a high fuel flow rate for brief periods of time. The instantaneous fuel flow rate and pressure created by valve 108 should be high enough to produce good atomization of the liquid fuel through the nozzle 110. However, the duty cycle of the valve 108 is set low enough to achieve the desired average fuel flow rate during operation of the burner. A volume capacitance of a combustion chamber 128 of the burner 101 is used to damp out the pulsed injections. In an embodiment in which the burner is used to heat a working gas of a Stirling engine, the thermal mass of the Stirling heater head will damp out the fluctuating heat releases caused by the intermittent injection of fuel.

Burner 101 also includes a fuel supply system to provide fuel to the intermittent fuel injector 100. Fuel flows from a fuel tank 102 to a pump 104 that produces the desired fuel pressure upstream of the valve 108. The fuel pressure may also be controlled by a back-pressure regulator 106 coupled to the fuel tank 102 and the pump 104. In a preferred embodiment, pump 104 is a positive displacement pump with a built-in pressure regulator and the back pressure regulator 106 is replaced with a fixed orifice or resistance. In one embodiment, the resistance and pump pressure are selected to provide enough cooling to keep the nozzle 110 below 150° C. The fuel pressure should be at least 25 psig in order to produce finely atomized fuel droplets at nozzle 110.

Excess fuel flows through the cooling loop 112 to cool the intermittent fuel injector 100, in particular nozzle 110. The nozzle 110 is in contact with the heated combustion air provided by air supply 120. The combustion air, in some applications, may be heated to temperatures as high as 700° C. The flow of excess fuel cools the injector as it passes through the cooling loop 112 before returning to the fuel tank 102. Cooling the injector serves to cool the intermittent fuel injector 100 so as to avoid coking of any fuel left in the small passages of nozzle 110. The fuel injected by fuel injector 100 is mixed with combustion air from swirlers 122 in throat 124 to form a fuel-air mixture. The fuel-air mixture then flows through the throat 124 and is ignited by an igniter (not shown) in the combustion chamber 128 to form a recirculting flame. In a preferred embodiment, the igniter is a spark plug. In an alternative embodiment, the igniter may be a glow plug.

As mentioned above, the average fuel flow rate is determined primarily by the duty cycle of the valve 108 and the fuel pressure. The frequency of the valve 108 may also impact the fuel flow rate. In addition, the frequency of the valve 108 has a marked effect on creating a self-sustaining flame in the combustion chamber 128. Below a given frequency, a constant ignition source is required to ignite the pulses of fuel injected from the intermittent fuel injector 100 into the combustion chamber 128. The minimum frequency of the valve 108 required to create a self-sustaining flame depends on several parameters including the volume of the combustion chamber 128, the flame speed of the fuel-air mixture, the duty cycle of the valve 108 and the spray characteristics of the intermittent fuel injector 100. For the embodiment in FIGS. 2*a* and 2*b* as discussed below, the self-sustaining frequency is preferably 32 Hz.

Valve 108 is controlled by a fuel-controller 130 that is coupled to the intermittent fuel injector 100 and the pump 104. Fuel controller 130 varies one or more parameters of the fuel injector 100 or pump 104 to control the fuel flow rate through the valve 108 and the nozzle 110. In one embodiment, where the liquid fuel burner is used in a thermal cycle engine (such as a Stirling engine) having a heater head, the fuel controller 130 controls the fuel flow rate to minimize the error between a desired heater head temperature 134 and a measured heater head temperature 132. Both the desired heater head temperature 134 and the measured heater head temperature 132 are inputs to the fuel controller 130. Fuel controller 130 may vary one or more of the following parameters of the fuel injector 100: duration of opening of valve 108, frequency of opening of valve 108 and amplitude of a control signal sent to the fuel injector to drive valve 108. The fuel controller may, for example, include a pulse width modulated drive to provide a pulse width modulated control signal to the valve 208. In a preferred embodiment, the operating ranges of frequency for valve 108 are 5 to 90 Hz with duty cycles from 2% to 100%. In addition, fuel controller 130 may vary the fuel pressure generated by the pump 104 to control the fuel flow rate.

Nozzle 110 atomizes the fuel by forcing it through a small opening. As mentioned above, methods of atomizing are well known in the art. In a preferred embodiment, the nozzle 110 is the smallest fuel pressure-atomizing nozzle generally available. In order to assure good atomization and therefore good emissions, it is necessary to allow only high or zero fuel flow rates through the nozzle 110. Therefore, it is important to avoid low fuel flow rates through the nozzle 110 as the valve 108 opens or just after it closes. Preferably, the fuel flow rate through valve 108 resembles a square wave control signal used by the controller 130 to drive valve 108. In order to avoid low fuel flows, a stiff fluid system is created that has a minimal amount of compliance between the pump 104, the regulator 106 and the nozzle 110. It is particularly important that the hydraulic system between the valve 108 and the nozzle 110 has minimal compliance. Compliance between the valve 108 and nozzle 110 is caused primarily by trapped gases between the valve 108 and the nozzle 110. Accordingly, nozzle 110 is placed as close as possible to the valve 108 to minimize the volume of fuel between the two elements. In addition, gases should be bled out of the space between the valve 108 and nozzle 110 during assembly of the injector 100. The open space should be arranged so that any remaining air is swept out of the volume between the valve 110 and the nozzle 108 as fuel flows from the valve to the nozzle.

Figure 2B:
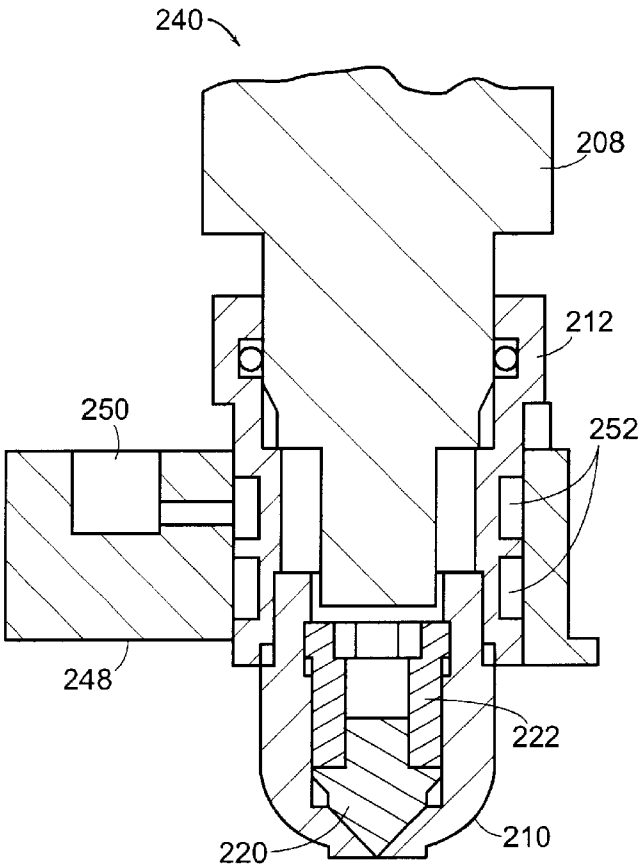
FIG. 2*b* is a cross sectional view of the fuel injector of FIG. 2*a* in accordance with an embodiment of the invention.
Figure 2A:
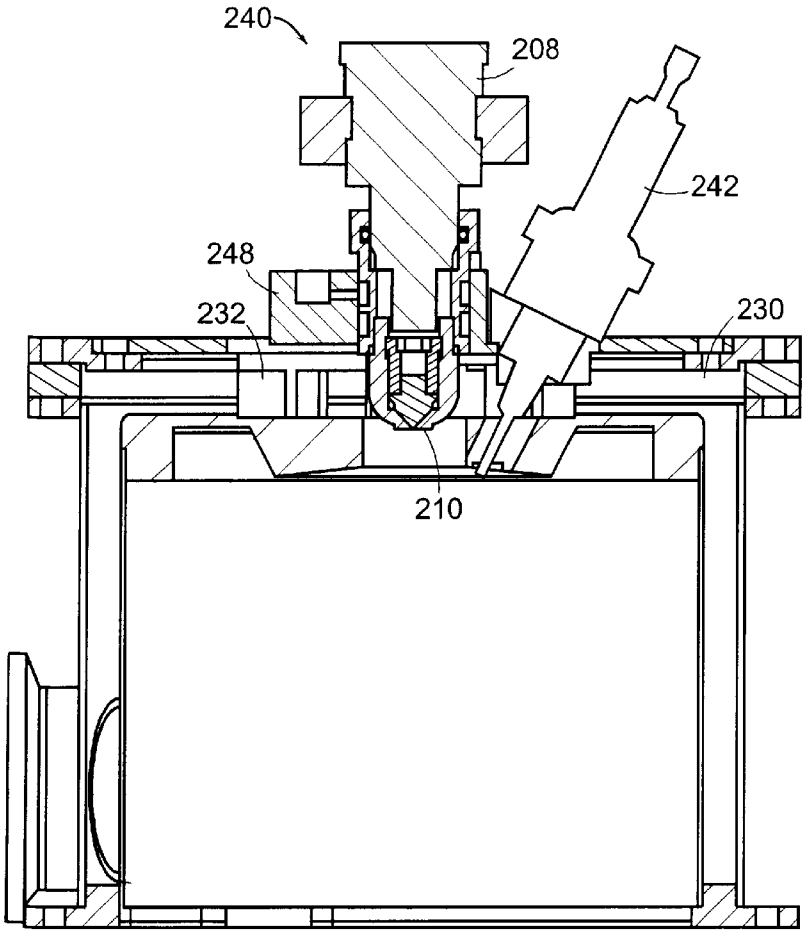
FIG. 2*a* is a cross sectional view of the burner and intermittent fuel injector in accordance with an embodiment of the invention.

FIG. 2*a* is a cross-sectional view of a burner with an intermittent fuel injector in accordance with an embodiment of the invention. Fuel injector 240 includes a fuel valve 208 such as an automotive fuel injector, typical of those found in multi-point fuel injection engines. Nozzle 210 may be a modified 0.5 gph, 60 degree, hollow cone oil nozzle. Preheated air flows through passages 230 to swirler 232. An automotive spark plug 242 may be used to ignite the fuel-air mixture.

Other known injector technologies may be adapted as the valve 108 (as shown in FIG. 1) or as both the valve 108 and the nozzle 110 (as shown in FIG. 1). These include injectors used for gasoline direct injection (GDI) and electronically controlled common rail diesel injectors. Both GDI and common rail injectors include an electronically controlled fast valve and a pressure atomizer nozzle.

FIG. 2*b* is a cross-sectional view of the fuel injector 240 of FIG. 2*a* in accordance with an embodiment of the invention. Nozzle 210 has a center-body 220 that is modified to work with a secondary oil filter 222, typical of lower fuel-flow rate nozzles. This construction allows the tip of the fuel valve 208 to be mounted very close to the oil nozzle 210. Preferably, in one embodiment, the volume between the valve 208 and nozzle 210 is approximately 2 $cm^3$.

An embodiment of the cooling loop 112 (as shown in FIG. 1) is also shown in FIG. 2*b*. The excess flow of fuel that bypasses fuel valve 208 of the fuel injector 240 flows into a cooling block 248 (also shown in FIG. 2*a*) via a first port 250. The fuel then flows around a fuel injector mount 212 through passages 252 before exiting through a second port (not shown). The cooling loop maintains the fuel flowing through nozzle 210 at a temperature below the decomposition temperature of the fuel.

Figure 3:
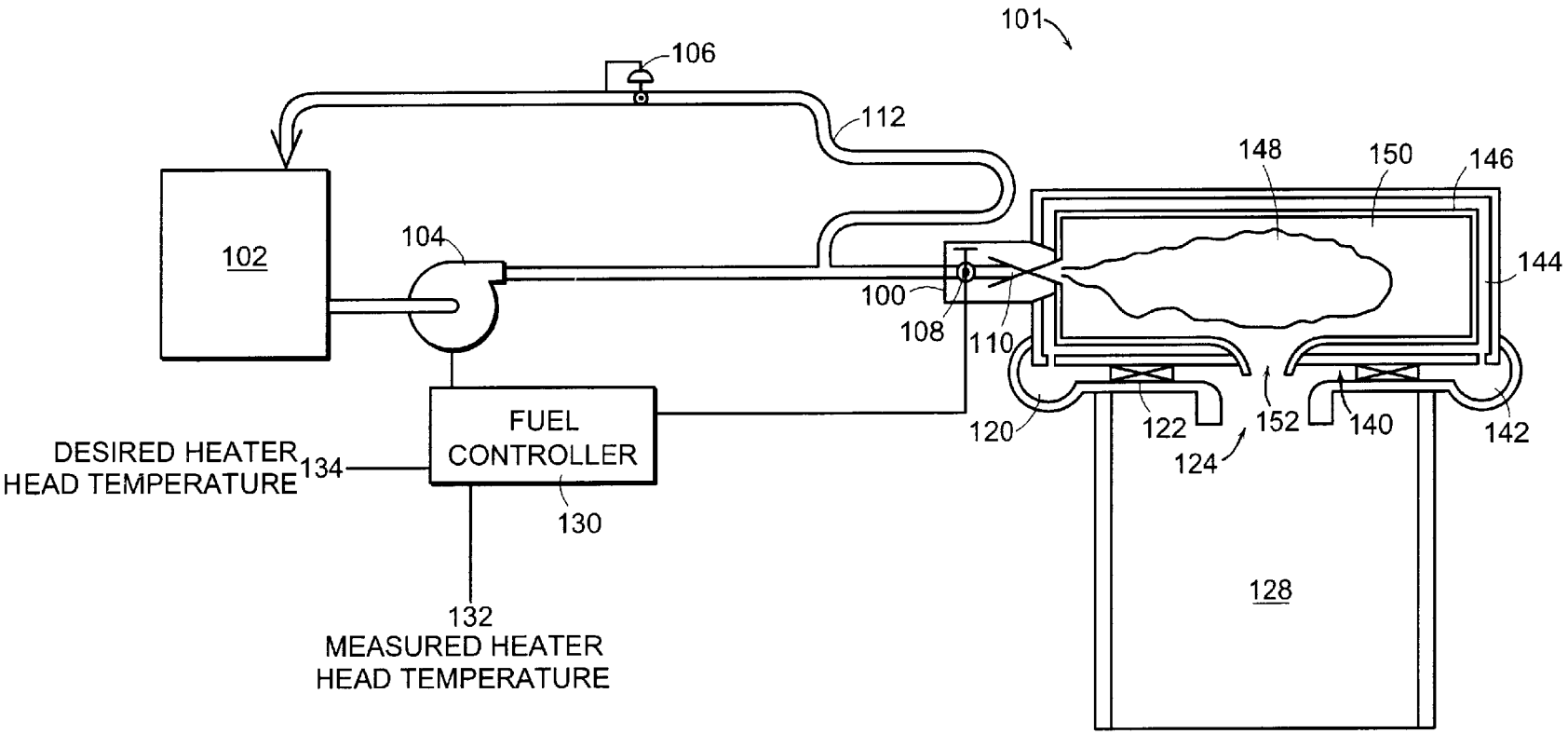
FIG. 3 is a schematic diagram of a burner with a fuel injector and a mixing chamber in accordance with an alternative embodiment of the invention.

FIG. 3 is a schematic diagram of a burner with a fuel injector and a mixing chamber in accordance with an alternative embodiment of the invention. A mixing volume 150 is provided to premix the injected fuel 148 and a portion of the combustion air 144 to form a rich fuel-air mixture. The rich fuel-air mixture is then mixed with the remaining portion of the combustion air 140 in the throat 124 and the combustion chamber 128 of the burner. In alternative embodiments, all the combustion air will flow through the mixing volume 150. The mixing volume 150 is also used to damp out the fuel pulses provided by the intermittent fuel injector 100. Preferably, the mixing volume 150 is made sufficiently large to produce a steady flow of fuel and air at an exit 152 of the mixing volume.

The combustion air supplied from the air supply 120 is directed through a restriction 142 to produce a primary air supply 144 and a secondary air supply 140. The primary air 144 then flows into the manifold entirely around the mixing chamber 150. The walls 146 of the mixing volume 150 are constructed of perforated material, preferably metal, to allow the primary air 144 to enter the mixing volume 150 and mix with the injected fuel 148. The perforated walls 146 have a lining of mesh or wire screen that serves two purposes. Firstly, fuel droplets that contact the wall 146 will be absorbed by the lining. Secondly, the lining encourages evaporation of the fuel from the heat of the incoming primary air 144. The evaporation is very important during operation of the burner with the preheated air. The secondary air flows through the swirler 122 and enters the burner throat 124. The secondary air then mixes with the richer fuel-air mixture from the mixing volume 150 to form a lean fuel-air mixture in the throat 124 of the burner. The lean fuel-air mixture then enters the combustion chamber 128 where it is ignited by an igniter (not shown).

During start up operation, the intermittent fuel injector 100 operates at a high firing rate depending only on the nozzle 110 for atomization. Once the metal walls 146 of the mixing volume 150 are heated, the fuel flow may be reduced so that some of the fuel evaporating off the walls 146 smoothes out the pulses of fuel through the exit 152 of the mixing volume 150. In addition, as mentioned above, the mixing volume 150 itself damps the fuel pulses from the intermittent fuel injector 100.

All of the systems and methods described herein may be applied in other applications besides the Stirling or other thermal cycle engine in terms of which the invention has been described. The described embodiments of the invention are intended to be merely exemplary and numerous variations and modifications will be apparent to those skilled in the art. All such variations and modifications are intended to be within the scope of the present invention as defined in the appended claims.

What is claimed is:

1. A liquid fuel burner for combusting a fuel from a fuel supply and air from an air supply, the fuel and air combined to form a fuel-air mixture, the liquid fuel burner comprising:

a. a fuel injector for injecting the fuel from the fuel supply into the air in a throat of the burner so that the fuel and air mix forming a fuel-air mixture, the fuel injector including:

i) a fast acting valve to provide a pulsed flow of fuel; and ii) a nozzle coupled to the valve for receiving and atomizing the pulsed flow of fuel;

b. a combustion chamber coupled to the throat of the burner for receiving the fuel-air mixture, the combustion chamber having an igniter to ignite the fuel-air mixture; and c. a fuel controller coupled to the fuel supply and the fuel injector, for governing a rate of fuel delivery by controlling the duration of an opening period of the valve.

2. A liquid fuel burner according to claim 1, wherein the fuel controller governs the rate of fuel delivery by varying the frequency of the fast acting valve.

3. A liquid fuel burner according to claim 1, further including a fuel pump coupled to the fuel supply, the fuel controller and the fuel injector, wherein the fuel controller governs the rate of fuel delivery by varying a fuel pressure delivered by the pump.

4. A liquid fuel burner according to claim 1, wherein the fuel controller governs the rate of fuel delivery by varying the frequency and duty cycle of the fast acting valve.

5. A liquid fuel burner according to claim 1, wherein the liquid fuel burner provides heat to a thermal cycle engine having a heater head for heating a working fluid by conduction, the fuel controller providing a control signal to the valve to maintain a heater head temperature at a desired heater head temperature.

6. A liquid fuel burner according to claim 1, further including a cooling loop coupled to the fuel supply and the fuel injector, for cooling the fuel injector.

7. A liquid fuel burner according to claim 1, wherein the valve is an automotive fuel injector designed for port fuel injection.

8. A liquid fuel burner according to claim 1, wherein the nozzle is a pressure-atomizing oil burner nozzle.

9. A liquid fuel burner according to claim 1, wherein the fuel injector includes an automotive gasoline direct injection fuel injector.

10. A liquid fuel burner according to claim 1, wherein the fuel injector includes a diesel common rail injector.

11. A liquid fuel burner according to claim 1, further comprising a mixing chamber coupled to the fuel injector, the mixing chamber for mixing the injected fuel and a portion of the air from the air supply before entry into the throat of the burner.

12. A liquid fuel burner according to claim 11, wherein the mixing chamber includes a mesh metal surface to absorb and evaporate the fuel.

13. A liquid fuel burner according to claim 11, wherein the mixing chamber has a plurality of openings through which the portion of air enters the mixing chamber.

14. A liquid fuel burner according to claim 12, wherein the mixing chamber is a cylinder aligned with the fuel injector.

* * * * *